US009059553B2

(12) United States Patent
Vinci et al.

(10) Patent No.: US 9,059,553 B2
(45) Date of Patent: Jun. 16, 2015

(54) APPARATUS FOR CLEANING ELECTRICAL TERMINALS

(71) Applicants: Ian R. Vinci, Shandaken, NY (US); Peter Vinci, Shandaken, NY (US)

(72) Inventors: Ian R. Vinci, Shandaken, NY (US); Peter Vinci, Shandaken, NY (US)

( * ) Notice: Subject to any disclaimer, the term of this patent is extended or adjusted under 35 U.S.C. 154(b) by 83 days.

(21) Appl. No.: 13/851,313

(22) Filed: Mar. 27, 2013

(65) Prior Publication Data

US 2014/0289980 A1 Oct. 2, 2014

(51) Int. Cl.
*H01R 43/00* (2006.01)
*B24D 15/04* (2006.01)

(52) U.S. Cl.
CPC ..... *H01R 43/002* (2013.01); *B24D 15/04* (2013.01)

(58) Field of Classification Search
CPC ..... H01R 43/002; B24D 15/00; B24D 15/04
USPC ..... 451/514, 515, 523, 524, 525
See application file for complete search history.

(56) References Cited

U.S. PATENT DOCUMENTS 1,334,971 A * 3/1920 Shore ..... 269/3
1,616,355 A 2/1927 Considine
2,405,680 A * 8/1946 Williams ..... 451/480
3,343,245 A * 9/1967 Sylvester ..... 451/486
3,504,459 A * 4/1970 Spiteri ..... 451/525
3,744,069 A * 7/1973 Grebow ..... 451/461
4,279,103 A * 7/1981 Rodarte ..... 451/522
4,333,214 A * 6/1982 Neumann et al. ..... 451/557
4,790,121 A * 12/1988 Roberts et al. ..... 451/492
5,307,595 A * 5/1994 Coleman ..... 451/59
5,594,966 A * 1/1997 Goldman ..... 451/523
6,171,177 B1 * 1/2001 Fitz ..... 451/59
8,296,893 B2 * 10/2012 Vinci et al. ..... 451/524

OTHER PUBLICATIONS

Innovative Products of America, Web page for "Diamond Grip Terminal Cleaners #8040," http://ipatools.com/products/index.php/ipa-8040.html, Mar. 20, 2013.

* cited by examiner

*Primary Examiner* — Maurina Rachuba
(74) *Attorney, Agent, or Firm* — Law Offices of Michael L. Wise, LLC

(57) ABSTRACT

Aspects of the invention are directed to an apparatus for cleaning electrical terminals. The apparatus comprises a first arm and a second arm. The first arm includes a first cleaning portion with a first upper face and a first lower face. Each of the first upper face and the first lower face are substantially flat and coated with an abrasive. In a similar manner, the second arm includes a second cleaning portion with a second upper face and a second lower face. Here again, each of the second upper face and the second lower face are substantially flat and coated with an abrasive. The second arm is pivotally coupled to the first arm, making the apparatus manually configurable into an aligned configuration in which the first lower face faces the second upper face.

7 Claims, 3 Drawing Sheets

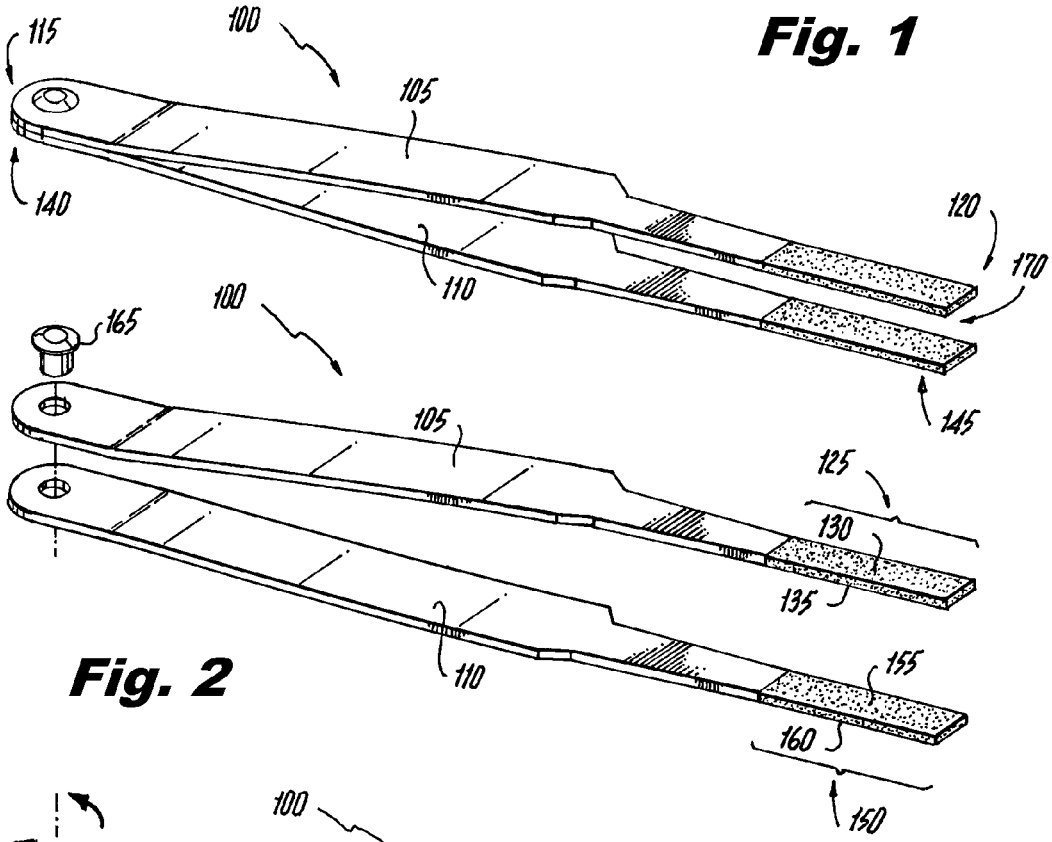
Fig. 1
Fig. 2
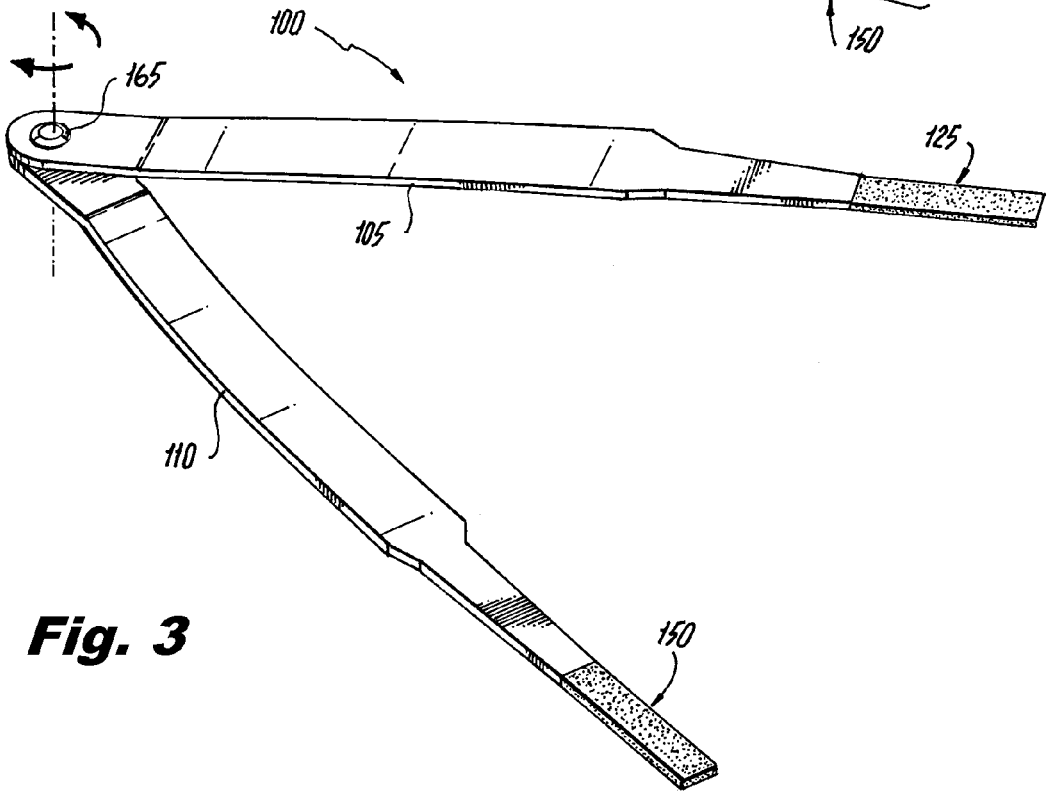
Fig. 3

Fig. 4
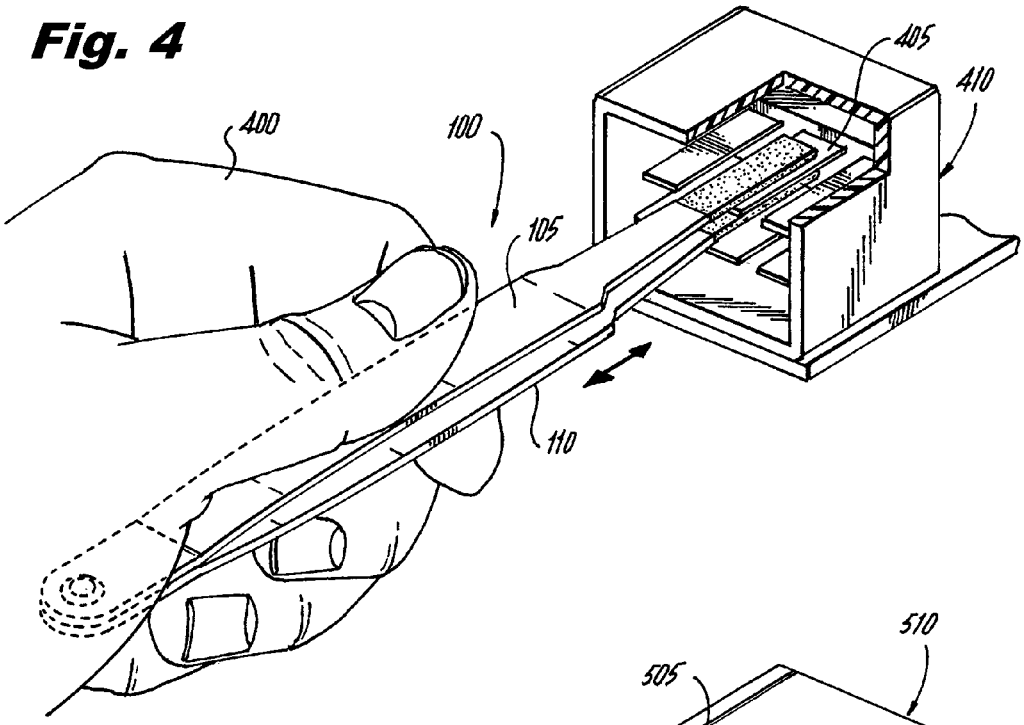
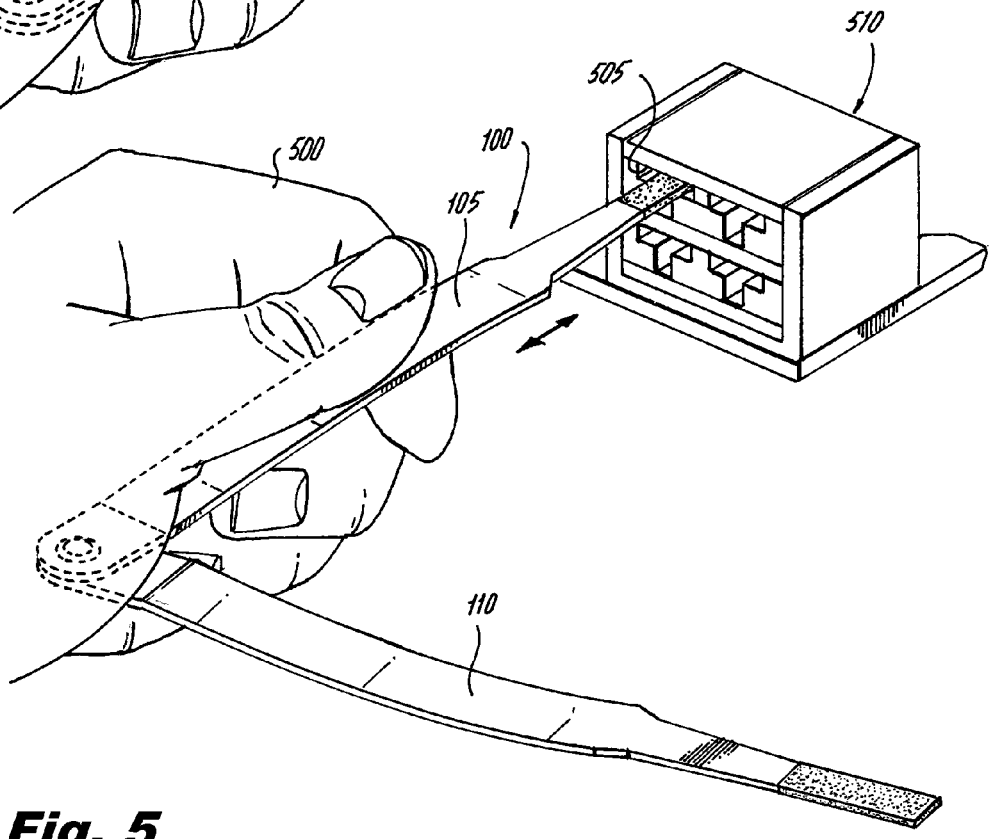
Fig. 5

APPARATUS FOR CLEANING ELECTRICAL TERMINALS

FIELD OF THE INVENTION

The present invention relates generally to electrical connectors, and, more particularly, to apparatus for cleaning electrical terminals.

BACKGROUND OF THE INVENTION

Electrical connectors may provide temporary or permanent interfaces in electrical circuits. At the time of this writing, there are literally hundreds of types of electrical connectors. One common type, for example, utilizes a flat conductive blade (i.e., a male blade terminal) and a corresponding blade receptacle (i.e., a female blade terminal) to form a manually disconnectable electrical connection. To facilitate the joining of several such terminals at once, the male blade terminals and female blade terminals may be installed in respective housings (e.g., jacks or plugs) that are themselves mechanically joinable.

Electrical connectors of the type described above are frequently exposed to harsh environments. For example, those connectors utilized to form electrical circuits between the electrical systems of trailers and tow vehicles are frequently positioned near the road and are therefore exposed to large amounts of dirt and moisture. Dirt can coat the electrical terminals, forming a high-resistance surface layer. Moisture, especially when combined with road salt, can corrode the electrical terminals. Ultimately, this dirt and/or corrosion can cause a trailer to no longer function properly and, consequently, create an unsafe driving condition.

For the foregoing reasons, there is a need for low-cost apparatus that make it easy and convenient to clean dirt and corrosion from electrical connectors such as blade-type electrical connectors so that these electrical connectors are capable of reliably forming and maintaining low-resistance electrical connections.

SUMMARY OF THE INVENTION

Embodiments of the present invention address the above-identified need by providing a apparatus well suited to removing corrosion and dirt from both male and female blade and spade electrical terminals, including those installed in housings (e.g., jacks or plugs).

Aspects of the invention are directed to an apparatus for cleaning electrical terminals. The apparatus comprises a first arm and a second arm. The first arm includes a first cleaning portion with a first upper face and a first lower face. Each of the first upper face and the first lower face are substantially flat and coated with an abrasive. In a similar manner, the second arm includes a second cleaning portion with a second upper face and a second lower face. Here again, each of the second upper face and the second lower face are substantially flat and coated with an abrasive. The second arm is pivotally coupled to the first arm, making the apparatus manually configurable into an aligned configuration in which the first lower face faces the second upper face.

BRIEF DESCRIPTION OF THE DRAWINGS

These and other features, aspects, and advantages of the present invention will become better understood with regard to the following description, appended claims, and accompanying drawings where:

FIG. 1 shows a perspective view of an electrical terminal cleaner in accordance with an illustrative embodiment of the invention;

FIG. 2 shows an exploded perspective view of the FIG. 1 electrical terminal cleaner;

FIG. 3 shows another perspective view of the FIG. 1 electrical terminal cleaner;

FIG. 4 shows a partially cutaway perspective view of the FIG. 1 electrical terminal cleaner while cleaning a male blade terminal;

FIG. 5 shows a perspective view of the FIG. 1 electrical terminal cleaner while cleaning a female blade terminal.

DETAILED DESCRIPTION OF THE INVENTION

Figure 6:
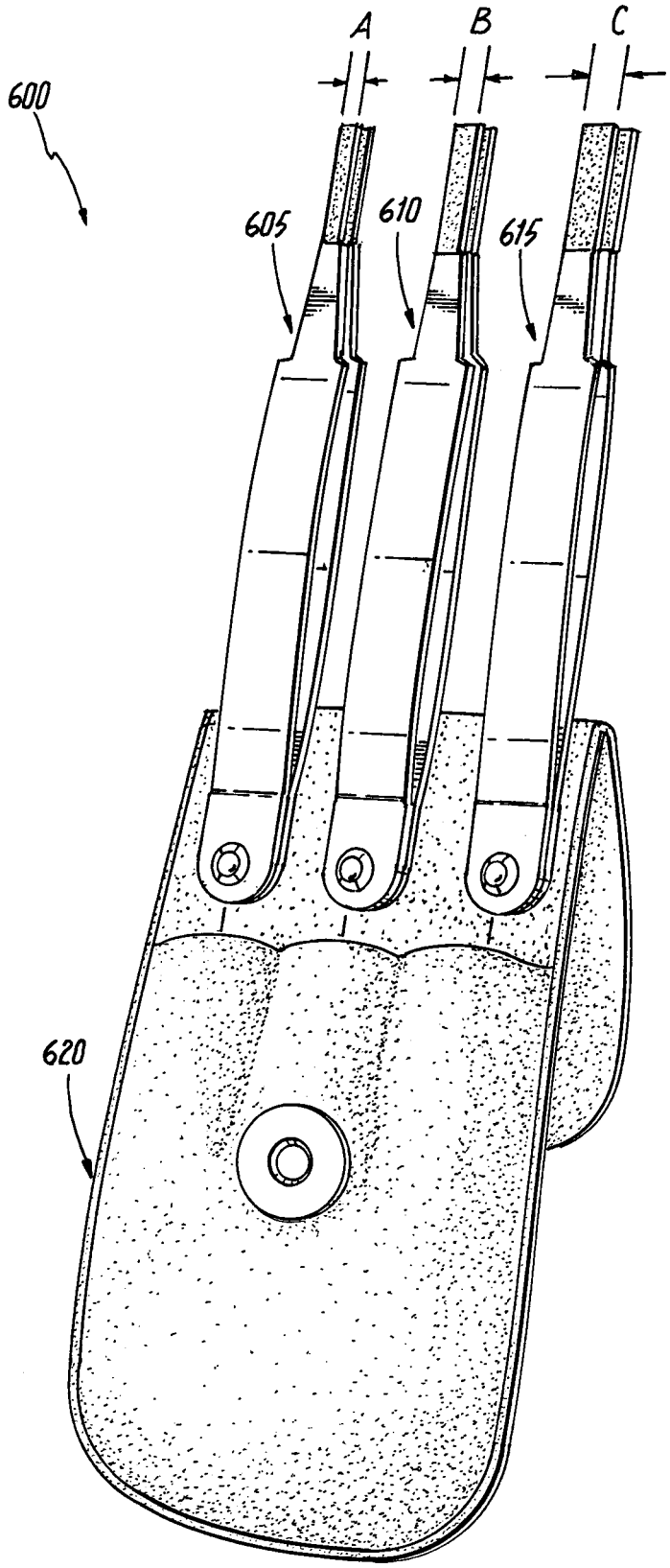
FIG. 6 shows a perspective view of an electrical terminal cleaning kit in accordance with an illustrative embodiment of the invention.

The present invention will be described with reference to illustrative embodiments. For this reason, numerous modifications can be made to these embodiments and the results will still come within the scope of the invention. No limitations with respect to the specific embodiments described herein are intended or should be inferred.

As used herein, the term "manually configurable" is intended to mean configurable by an average human being using only his or her hands without tools. Similarly, the term "operative to be manually pivoted," as used herein, is intended to mean capable of being pivoted by an average human being using only his or her hands without tools. Finally, as used herein, the term "springy" is intended to mean possessing the quality of quickly returning to an original shape after a pressing force is removed.

FIGS. 1-3 show aspects of an electrical terminal cleaner 100 in accordance with an illustrative embodiment of the invention. More particularly, FIG. 1 shows a perspective view, FIG. 2 shows an exploded perspective view, and FIG. 3 shows even another perspective view with the electrical terminal cleaner in a different configuration from that in FIG. 1.

The electrical terminal cleaner 100 comprises a first arm 105 and a second arm 110. The first arm 105 defines a first proximal end 115 and a first distal end 120. In the present embodiment, the first arm 105 has a maximum width near the first proximal end 115, and necks down as one approaches the first distal end 120. Proximate to the first distal end 120, a first cleaning portion 125 defines a first upper face 130 and a first lower face 135. Both the first upper face 130 and the first lower face 135 are substantially flat and are coated with an abrasive. The second arm 110, in turn, is largely a mirror image of the first arm 105. Specifically, the second arm 110 defines a second proximal end 140 and a second distal end 145. A second cleaning portion 150 defines a second upper face 155 and a second lower face 160. Both the second upper face 155 and the second lower face 160 are also substantially flat and are coated with an abrasive.

The second arm 110 is pivotally coupled to the first arm 105 proximate to the respective proximal ends 115, 140 of the two arms 105, 110. In the particular illustrative embodiment shown in FIGS. 1-3, this coupling is facilitated by a rivet 165, which passes through holes in each of the arms 105, 110. The rivet 165 allows the second arm 110 to be manually pivoted 360 degrees in relation to the first arm 105 (see FIG. 3). The electrical terminal cleaner 100 may therefore take on a continuum of different configurations depending on the relative positions of the first and second arms 105, 110. An "aligned" configuration is shown in FIGS. 1 and 2. In the aligned configuration, the first arm 105 and the second arm 110 project from the rivet 165 in the same direction, and the first lower face 135 of the first arm 105 faces the second upper face 155 of the second arm 110. At the same time, the first arm 105 and the second arm 110 angle away from each other as one moves from the rivet 165 towards their respective distal ends 120, 145. The first distal end 120 therefore does not directly contact the second distal end 145. Instead, a gap 170 is defined between the first cleaning portion 125 and the second cleaning portion 150.

The first arm 105 and the second arm 110 are preferably formed of a springy material that allows a user to manually press the first lower face 135 against the second upper face 155 by pressing the first arm 105 and the second arm 110 towards one another while the electrical terminal cleaner 100 is in the aligned configuration. Correspondingly, the same springiness then causes the two arms 105, 110 to naturally return to their original, separated state as soon as the pressing force is relieved. In this manner, the electrical terminal cleaner 100 may be manipulated somewhat in the manner of a set of tweezers, at least while in the aligned configuration. However, rather than having ends intended for grabbing or holding an object in the manner of tweezers, the present electrical terminal cleaner 100 is instead fitted with substantially flat ends coated in an abrasive.

The electrical terminal cleaner 100, and more generally, apparatus in accordance with aspects of the invention are well suited for cleaning electrical terminals, particularly those configured as blades or spades. To illustrate this point, FIG. 4 shows a partially cutaway perspective view of a user 400 utilizing the electrical terminal cleaner 100 to clean a male blade terminal 405 contained in a housing 410 (e.g., a jack or plug) with five other male blade terminals. In the figure, the user 400 has placed the electrical terminal cleaner 100 into its aligned configuration and has inserted the male blade terminal 405 into the gap 170 between the first cleaning portion 125 and the second cleaning portion 150. The user 400 has then pressed the first arm 105 and the second arm 110 towards one another so that the first lower face 135 of the first arm 105 contacts one contact surface of the male blade terminal 405 and, simultaneously, the second upper face 155 of the second arm 110 contacts the opposite contact surface of the blade terminal 405. As indicated in the figure, the male blade terminal 405 is thereby positioned between the first cleaning portion 125 and the second cleaning portion 150. Once so positioned, translating the electrical terminal cleaner 100 back and forth has the effect of causing the abrasive surfaces of the first cleaning portion 125 and second cleaning portion 150 to simultaneously abrade the two contact surfaces of the male blade terminal 405. This acts to remove any dirt or corrosion from the male blade terminal 405 in a quick and easy manner.

The electrical terminal cleaner 100 can also easily clean female blade or spade terminals, including those contained in housings. In the case of female blade or spade terminals, however, the aligned configuration may not be ideal, and, instead, it may be advantageous to manually configure the electrical terminal cleaner 100 so that the two arms 105, 110 project from the rivet 165 in different directions. FIG. 5 shows a perspective view of a user 500 utilizing the electrical terminal cleaner 100 to clean a female blade terminal positioned behind a slot 505 in a housing 510 that contains three other female blade terminals. Here, the user 500 has swung the second arm 110 of the electrical terminal cleaner 100 out of the way and has inserted the first cleaning portion 125 of the first arm 105 into the slot 505. So positioned, translating the electrical terminal cleaner 100 back and forth has the result of causing one or both of the first upper face 130 and the first lower face 135 of the first arm 105 to abrade the contact surface of the female blade terminal behind the slot 505. At the same time, the second arm 110 remains out of the way and does not mechanically interfere with this cleaning process.

As indicated above, the electrical terminal cleaner 100 is preferably formed of a springy material. Suitable springy materials include, as just one example, thin stainless steel. In one or more embodiments, for example, the stainless steel may have a thickness of about 0.020 inches, although it is emphasized that this specific thickness value is merely illustrative and not intended to be limiting. The abrasive may comprise, any material capable of being adhered to the cleaning portions 125, 150 of the electrical terminal cleaner 100 and capable of removing dirt and corrosion on electrical terminals by rubbing. The abrasive may, therefore, comprise, as just a few illustrative examples, diamond, aluminum oxide, tungsten carbide, and silicon carbide. The pivotal connection between the first arm 105 and the second arm 110 may be by any suitable coupling means including, but not limited to, a rivet, a pin, a bolt, a screw, and the like.

With regard to shape, three sizes have been identified that appear to adequately cover the range of commonly-utilized blade and spade terminals. FIG. 6 shows a perspective view of an electrical terminal cleaning kit 600 in accordance with an illustrative embodiment of the invention. The kit 600 comprises a small electrical terminal cleaner 605, a medium electrical terminal 610, and a large electrical terminal cleaner 615, which are conveniently provided in a leather or plastic pouch 620. The three electrical terminal cleaners 605, 610, 615 have different widths at their respective distal ends, labeled "A," "B," and "C" in the figure. In one non-limiting embodiment, dimension A may be equal to about 0.063 inches, dimension B may be equal to about 0.094 inches, and dimension C may be equal to about 0.18 inches. Nevertheless, these dimensions are again merely illustrative and not intended to be limiting. That is, in actual reduction to practice, embodiments of the invention may utilize very different dimensions and these embodiments will still come within the scope of the invention.

It should again be emphasized that the above-described embodiments of the invention are intended to be illustrative only. Other embodiments can use different types and arrangements of elements for implementing the described functionality. Alternative embodiments, for example, may have very different shapes from those set forth above, and these embodiments would still come within the scope of the invention. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in 35 U.S.C. §112, ¶6. In particular, the use of "step of" in the claims herein is not intended to invoke the provisions of 35 U.S.C. §112, ¶6.

What is claimed is:

1. An apparatus comprising:

a first arm, the first arm comprising a first cleaning portion with a first upper face and a first lower face, each of the first upper face and the first lower face being substantially flat and coated with an abrasive;

a second arm, the second arm comprising a second cleaning portion with a second upper face and a second lower face, each of the second upper face and the second lower face being substantially flat and coated with an abrasive; and a fastener, the fastener passing through the first arm and the second arm proximate to respective ends of the first arm and the second arm, and pivotally coupling the first arm to the second arm;

wherein the apparatus is manually configurable into an aligned configuration in which the first lower face faces the second upper face;

wherein the apparatus is manually configurable into an unaligned configuration in which the first arm and the second arm project from the fastener in different directions, and the first lower face does not face the second upper face;

wherein the first arm and the second arm are springy in a direction towards and away from each other while the apparatus is in the aligned configuration such that the first lower face and the second upper face can be made to move towards each other by pressing the first arm and the second arm towards one another, and the first lower face and the second upper face can be made to move away from each other by subsequently relieving that pressing force.

2. The apparatus of claim 1, wherein the first lower face and the second upper face define a gap therebetween when the apparatus is in the aligned configuration and no external forces are applied thereto.

3. The apparatus of claim 1, wherein the apparatus is manually configurable into a pressed state in which the first lower face contacts the second upper face by pressing the first arm and the second arm towards each other while the apparatus is in the aligned configuration.

4. The apparatus of claim 1, wherein the apparatus comprises steel.

5. The apparatus of claim 1, wherein the fastener comprises at least one of a rivet, a pin, a bolt, and a screw.

6. The apparatus of claim 1, wherein the abrasive comprises at least one of diamond, aluminum oxide, tungsten carbide, and silicon carbide.

7. The apparatus of claim 1, wherein the second arm is operative to be manually pivoted 360 degrees relative to the first arm.

* * * * *